US005610691A

United States Patent [19]

Takahashi et al.

[11] Patent Number: 5,610,691

[45] Date of Patent: Mar. 11, 1997

[54] IMAGE FORMING APPARATUS HAVING A CONTACT CHARGING MEMBER AND A CLEANING MEMBER

[75] Inventors: Sadao Takahashi, Tokyo; Hirohisa Ohtsuka, Kawaguchi; Takaaki Tawada, Yokohama, all of Japan

[73] Assignee: Ricoh Company, Ltd., Tokyo, Japan

[21] Appl. No.: 541,505

[22] Filed: Oct. 10, 1995

[30] Foreign Application Priority Data

Oct. 11, 1994 [JP] Japan ..... 6-244999
Oct. 5, 1995 [JP] Japan ..... 7-258553

[51] Int. Cl.[6] ..... G03G 15/02

[52] U.S. Cl. ..... 399/176; 361/225; 399/100

[58] Field of Search ..... 355/219; 361/225; 430/902

[56] References Cited

U.S. PATENT DOCUMENTS 5,241,343 8/1993 Nishio ..... 355/219
5,406,357 4/1995 Nakahara et al. ..... 355/245

FOREIGN PATENT DOCUMENTS 2198468 8/1990 Japan .
34246 1/1991 Japan .
3132783 6/1991 Japan .
4361288 12/1992 Japan .
63930 1/1994 Japan .

*Primary Examiner*—Joan H. Pendegrass
*Assistant Examiner*—Quana Grainger
*Attorney, Agent, or Firm*—Oblon, Spivak, McClelland, Maier & Neustadt, P.C.

[57] ABSTRACT

An image forming apparatus includes a contact charging member which contacts a surface of an image carrier member in order to charge the surface of the image carrier member, and a cleaning member which contacts and slides on a surface of the contact charging member in order to clean the surface of the contact charging member. The image forming apparatus performs a function in such a way that after an electrostatic latent image is produced on the image carrier member which is in a charged state, toner powder is supplied to the image carrier member by a developing device in order to make the electrostatic latent image visible and then a visualized image is transferred to a transfer member. In the image forming apparatus, a maximum height of concavities and convexities formed on the surface of the contact charging member is equal to or less than an average particle diameter of the toner powder supplied by the developing device.

7 Claims, 3 Drawing Sheets

IMAGE FORMING APPARATUS HAVING A CONTACT CHARGING MEMBER AND A CLEANING MEMBER

BACKGROUND OF THE INVENTION

1. Field of the Invention

This invention relates to an image forming apparatus, such as a copying machine, a printer, a facsimile, etc., in which an electrostatic photographic technology is employed.

2. Description of the Prior Art

An image forming apparatus is widely used which performs the following process. A photosensitive layer of the surface of an image carrier member is uniformly charged by a charging member. Optical image information is then supplied to the image carrier member in order to produce an electrostatic latent image. Thereafter, a toner, which is usually held in a powder-like state, is supplied to the electrostatic latent image in order to make the latent image visible, and then the toner image is electrostatically transferred to a sheet-like transfer member such as paper. This sequence of procedures are repeated as often as required.

As photoconductive materials of the photosensitive layer of the image carrier member of the image forming apparatus, use is made of selenium, cadmium oxide, zinc oxide, etc., which are each an inorganic photoconductive material. Besides those materials, recently, a wide variety of organic compounds have been employed.

As examples of those organic compounds, use is made of an organic photoconductive polymer (e.g., poly-N-vinylcarbazole and polyvinylanthracene), a low molecular organic photoconductive material (e.g., carbazole, anthracene, pyrazolines, oxadiazoles, hydrazones, and polyarylalkanes), organic dyes (e.g., cyanide dye, indigo dye, thioindigo dye, and squaric acid methane), or organic pigment (e.g. phthalocyanine pigment, azo pigment, polycyclicquinone pigment, and perylene segment).

Since these substances are easy to compose compared with the afore-mentioned inorganic photoconductive materials and tend to form ones which exhibit photoconducting in an appropriate wavelength band, they are used more frequently. For example, U.S. Pat. Nos. 4,123,270, 4,251,613, 4,251,624, 4,256,821, 4,260,672, 4,268,596, 4,278,747, 4,293,628, etc. disclose an image forming apparatus in which an azo pigment exhibiting photoconductive properties is utilized for an image carrier member as an electric charge generating layer in a photosensitive layer which is divided into the electric charge generating layer and an electric charge transporting layer according to functions.

In an image forming process utilizing such an image carrier member, there is, in many cases, employed a corons discharge type charging member as means for charging the image carrier member, in which the image carrier member is charged by corona generated by applying a high D.C. voltage of about 5 to 8 kv to a metal wire of a charge device.

However, in a charging member of this type, ozone and nitrogen oxides are generated when corons discharge is made. The generation of ozone and nitrogen oxides often gives damage to the carrier member itself. Also, those ozone and nitrogen oxides can be a cause of image deterioration by being stuck to the image carrier member. Moreover, this type of charging member has another problem in that the amount of the discharged current flowing toward the image carrier member is so small as about 5% to 30% and thus inefficient.

In order to obviate the above-mentioned drawbacks, a contact-to-charge type charging member is proposed which is designed such that the charging member is directly contacted with an image carrier member. According to this type of charging member, the charging member in the form of a roller, a belt, a blade, or the like is brought into contact with the surface of the image carrier member, and then a D.C. voltage or a voltage in which an alternating current is superimposed on a direct current is applied to the charging member to charge the image carrier member.

The above-mentioned contact-to-charge type charging member has advantages in that there is no generation of ozone and nitrogen oxides and voltage can efficiently be applied to the image carrier member. On the other hand, it has disadvantages in that since the charging member is in contact with the image carrier member, foreign matters, such as toner and paper powder, are readily stuck to the charging member, thus causing image deterioration.

In view of the above, Japanese Laid-Open Patent Application No. Hei 2-272589 discloses a construction in which a cleaning member made of a felt material is brought into contact with a charging member so that the surface of the charging member is cleaned by the cleaning member.

However, in the image forming apparatus disclosed in the above publication, since the cleaning member with respect to the charging member is selected in view of a kind of material, cleaning effect of the cleaning member on the charging member is significantly fluctuated depending on roughness of the surface of the charging member and the particle diameter of the toner powder stuck to the charging member.

Furthermore, the cleaning effect on the charging member is also significantly fluctuated depending on the relationship between roughness of the surface of the charging member and the thickness of fibers constituting the cleaning member.

The inventors of the present application have studied hard paying attention to those points mentioned above and finally accomplished the present invention.

It is therefore a first object of the present invention to efficiently remove the toner powder stuck to the surface of a contact charging member by means of a cleaning member in the light of a relationship between roughness of the surface of the contact charging member and the particle diameter of the toner powder stuck to the surface of the contact charging member.

A second object of the present invention is to efficiently remove the toner powder stuck to a contact charging member in the light of a relationship between roughness of the surface of the contact charging member and the thickness of fibers constituting a cleaning member.

A third object of the present invention is to achieve the first and second objects at a low cost.

SUMMARY OF THE INVENTION

In order to achieve the above objects, an image forming apparatus according to the present invention comprises a contact charging member which contacts a surface of an image carrier member in order to charge the surface of the image carrier member, and a cleaning member which contacts and slides on a surface of the contact charging member in order to clean the surface of the contact charging member, the image forming apparatus performing a function in such a way that after an electrostatic latent image is produced on the image carrier member which is in a charged-state, toner powder is supplied to the image carrier member by a developing means in order to visualize the electrostatic latent image and then a visualized image is transferred to a transfer member, wherein a maximum height of concavities and convexities formed on the surface of the contact charging member is equal to or less than an average particle diameter of the toner powder supplied by the developing means. Preferably, the maximum height of concavities and convexities is equal to or more than 2 μm. The construction makes it possible to effectively remove the toner powder stuck to the contact charging at a low cost.

Also, a slide contact portion of the cleaning member with respect to the contact charging member is constituted of a group of fibers, and a thickness of each fiber constituting the group of fibers is equal to or less than twice the average particle diameter of the toner powder.

According to this construction, each fiber acts on the toner powder. The force of each fiber acting on the toner powder can be decomposed into a component force for urging the toner power toward the contact charging member and another component force for urging the toner powder in the sweeping-out direction. If the thickness of fibers is reduced as much as possible with respect to the average particle diameter of the toner powder, the component force for urging the toner powder toward the contact charging member can be reduced and the other component force for urging the toner powder in the sweeping-out direction can be increased. By this, the contact charging member can more efficiently be cleaned.

The contact charging member is constituted of a roller which has a rubber elastic layer on an upper layer of a conductive core. The rubber elastic layer has a surface layer formed on a surface thereof. This arrangement makes it possible to easily remove the toner powder stuck to the surface layer.

The average particle diameter of the toner powder is preferably equal to or less than 12 μm and more preferably equal to or less than 8 μm.

DETAILED DESCRIPTION OF THE PREFERRED EMBODIMENTS

Embodiments of the present invention will now be described in detail with reference to the accompanying drawings.

Figure 7:
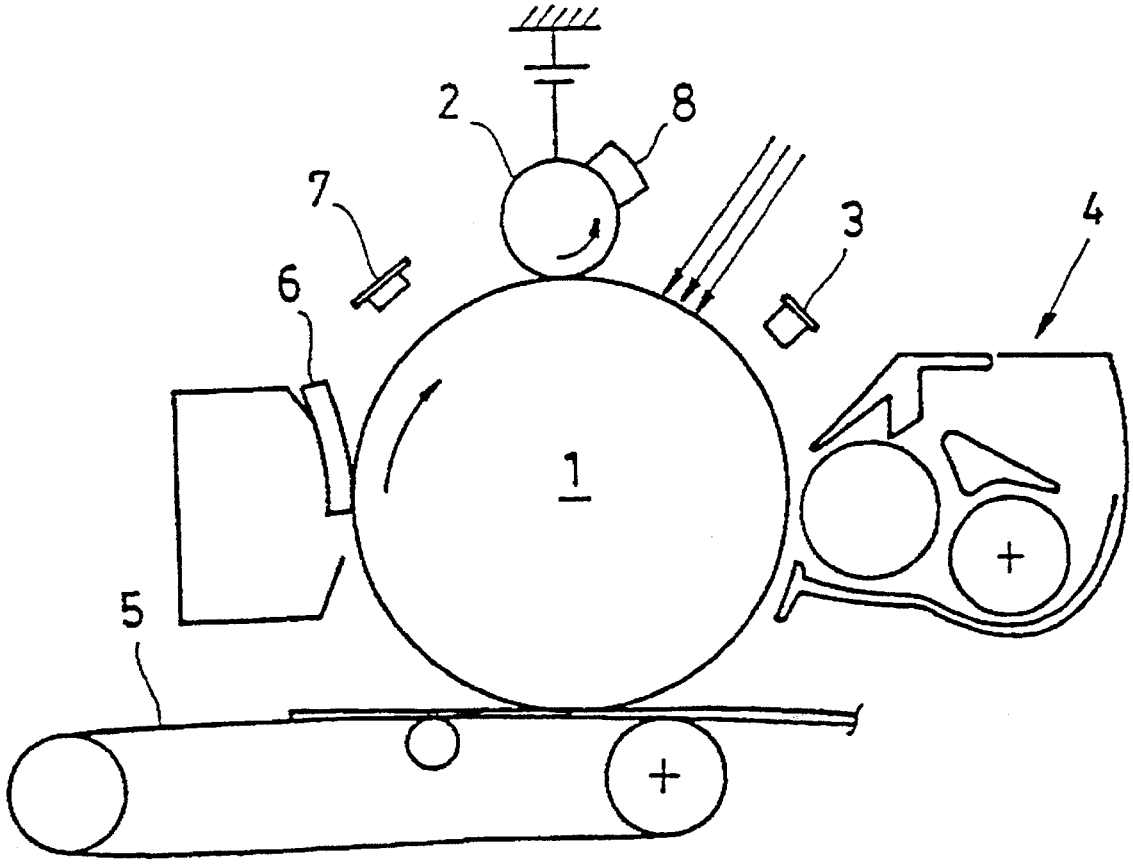
FIG. 7 is a schematic view for explaining an overall construction of an image forming apparatus according to one embodiment of the present invention.

With reference to FIG. 7, a description will be first given of a general construction of an image forming apparatus according to one embodiment of the present invention.

In FIG. 7, an image carrier member 1 is rotatable clockwise. Around the periphery of this image carrier member 1, there are arranged various members such as a contact charging member 2 capable of contacting and separating from the image carrier member 1, an eraser 3, a developing unit 4, a transfer belt 5 capable of contacting and separating from the image carrier member 1, a cleaning blade 6, and a quenching means 7. The surface of the image carrier member 1 is uniformly charged by the contact charging member 2 which is in contact with the image carrier member 1, and then an image is exposed or written by an optical imaging means, not shown, and as a result, an electrostatic latent image is produced on the surface of the image carrier member 1. With respect to this electrostatic latent image, the electrostatic charge in an area outside, for example, the size of a transfer paper to be supplied, is removed (or trimmed) by the eraser 3, and a developing process is performed. In the developing process, the developing unit 4 supplies toner powder to the electrostatic image on the surface of the image carrier body 1 in order to form a toner image on the surface of the image carrier body 1.

Subsequently, the routine proceeds to a transfer process. In the transfer process, a transfer paper supplied from a supplier means, not shown, is sent between the image carrier member 1 and the transfer belt 5 synchronously with the toner image. A bias is applied to the transfer belt 5. By this, the toner image is transferred onto the transfer paper sandwiched between the transfer belt 5 and the image carrier member 1. After the completion of the transfer process, a toner residual image is removed by the cleaning blade 6 from the surface of the image carrier member 1. Then, a remaining electric charge is removed by exposure light coming from the quenching means 7. On the other hand, the transfer paper, onto which the toner image has been transferred, is separated away from the image carrier member 1, sent to a fixing unit, not shown, via a passage, not shown, and then discharged outside the apparatus after the toner image has been fixed onto a paper surface.

In the image forming apparatus, the contact charging member 2 includes a metallic center shaft (for example, stainless steel of ϕ8 mm), an intermediate layer constituted of a conductive elastic rubber material (for example, epichlorohydrine rubber having a layer thickness of 3 mm and a rubber hardness of 35° to 45°) formed on the periphery of the metallic center shaft, and a conductive (having a resistance of $10^8$ to $10^{14}$ Ω·cm) surface layer having a layer thickness of 4.5 μm to 12 μm formed on the intermediate layer. The surface layer is constituted of a mixture of, for example, fluororesin and other material. With this feature, the toner powder stuck to the surface is readily removed by acting force of the cleaning member. The fluororesin is a material having a low coefficient of friction, so that the surface layer is prevented from being worn by the hard rubbing of the cleaning member and toner powder against the surface layer. Further, in order to enhance the adhering force of the fluororesin with respect to the rubber layer, the fluororesin is mixed with a material (for example, epichlorohydrine of homogeneity) having a favorable compatibility with the rubber layer. With this feature, the surface layer is prevented from peeling off. The contact charging member is in the form of a roller here. The surface layer is brought into contact with the image carrier member 1, and then a voltage is applied to the metallic center shaft from a power source, not shown. The power source is supplied to the image carrier member 1 via the metallic center shaft, intermediate layer, and surface layer, and as a result, the surface of the image carrier member 1 is electrically charged.

The cleaning member 8, which is in the form of a blade, a roller, a pad, a web of the like, is in abutment with the surface of the contact charging member 2 over the entire length thereof. The cleaning member 8 is provided with a group of fibers at a slide-contact portion thereof with respect to the contact charging member 2. Any foreign matters, such as paper powder, toner powder, etc., stuck to the surface of the contact charging member 2 are removed by the group of fibers.

The group of fibers can be constituted of various known materials, such as polyethylene, polypropylene, polyester, polyurethane, polyamide, cellulose, acrylic, and the like. The group of fibers may be in the form of a woven fabric, a nonwoven fabric, a felt or the like.

Because it is necessary that the contact charging member 2 contacts the image carrier member 1 and rotates in response to the rotation of the image carrier member 1, a certain frictional force must be acted between the contact charging member 2 and the image carrier member 1. For this reason, the surface of the contact charging member 2 has a finish of an irregular surface. As a consequence, the residual toner powder having a very small particle diameter, in particular, enters the concavities of the contact charging member 2, thus forming a multilayer or a state in which the residual toner powder adheres as a group.

In this embodiment, first, the cleaning effect on the contact charging member 2 is enhanced by paying attention to the relationship between the surface roughness (Rmax) of the contact charging member 2 and the particle diameter of the toner powder stuck to the surface of the contact charging member 2.

Figure 1:
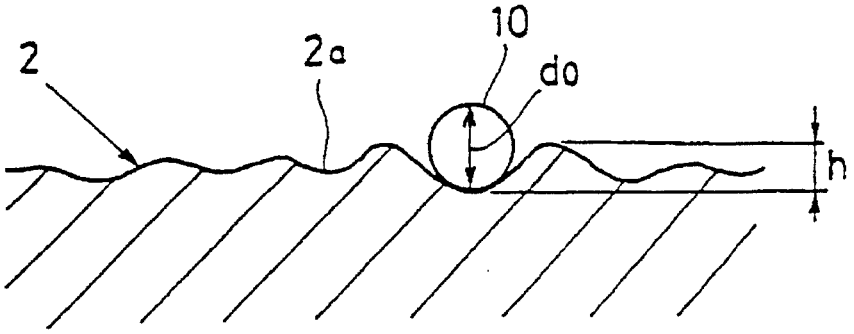
FIG. 1 is a front view, partly in section, for explaining a relationship between an average particle diameter of toner powder and roughness of the surface of a contact charging member, according to one embodiment of the present invention.

Specifically, as shown in FIG. 1, a surface 2*a* of the contact charging member 2 is formed such that the maximum height h of concavities and convexities existing on the surface 2*a* of the contact charging member 2 is equal to or less than an average particle diameter (volumetric average particle diameter) of the toner powder 10 supplied from the developing unit 4.

Owing to the surface 2*a* thus constructed of the contact charging member 2, even if particles of the toner powder 10 enter the concavities existing on the surface 2*a* of the contact charging member 2, the particles partly appear from the concavities. Therefore, the cleaning member 8 is brought into abutment with the exposed portion of the particles in order to remove the toner powder 10.

With respect to the toner powder 10 having an average particle diameter or less than the average, the toner powder 10 is all readily received in the concavities. In order to prevent the entry of the toner powder 10 into the concavities, it is advisable that the maximum height h of the concavities and convexities existing on the surface 2*a* of the contact charging member 2 is made equal to or less than minimum particle diameter of the toner powder 10 to be supplied. If the height is arranged so, it becomes difficult to obtain the frictional resistance between the contact charging member 2 and the image carrier member 1. Moreover, the surface finish of such a high degree of precision is not practical also in view of the processing costs.

First, since the contact area with respect to the toner powder is increased, the adhering force of the toner powder is also increased. Second, since the surface is required to be subjected to precision cutting in order to form a smooth and flat surface, costs are increased. Consequently, it is desirable that the surface roughness of the contact charging member 2 is made greater than or equal to 2 μm. If the surface roughness of the contact charging member 2 is less than 2 μm, effective cleaning cannot be expected by the method in which the toner is moved and removed from the surface of the contact charging member 2 by the cleaning member.

Accordingly, in the present invention, attention is paid to the average particle diameter of the toner powder 10 to be supplied.

Next, in this embodiment, the cleaning effect on the contact charging member 2 is enhanced by paying attention to the relationship between the surface roughness of the contact charging member 2 and the thickness of the fibers constituting the cleaning member 8.

Figure 2:
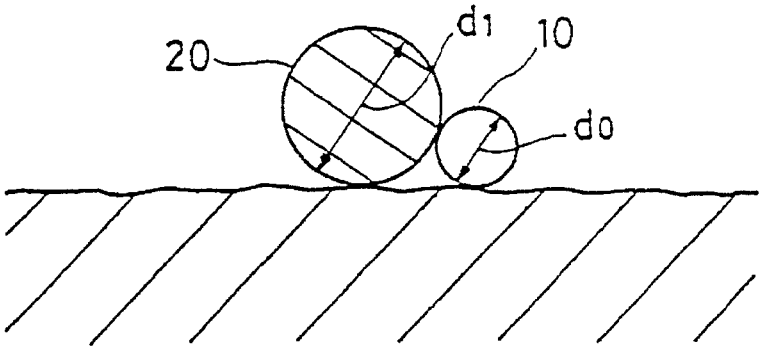
FIG. 2 is a front view, partly in section, for explaining a relationship between an average particle diameter of toner powder and a thickness of fibers constituting a cleaning member, according to one embodiment of the present invention.
Figure 3:
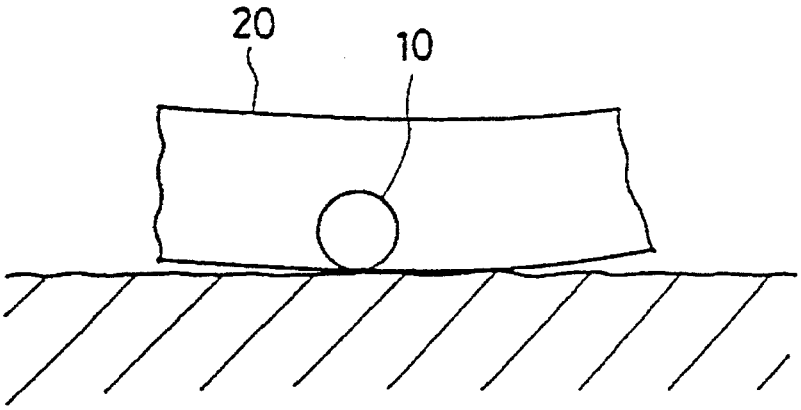
FIG. 3 is a side view, partly in section, of FIG. 2.

Specifically, as shown in FIGS. 2 and 3, the fibers 20 constituting the group of fibers arranged on the slide-contact portion of the cleaning member 8 are formed not to be too thick with respect to the average particle diameter d0 of the toner powder 10 to be applied from the developing unit 4, and preferably to be a thickness d1 which is equal to or less than twice the average particle diameter of the toner powder 10.

This arrangement makes it possible to efficiently remove the toner powder 10 since the fibers 20 of the cleaning member 8 can afford to apply a large force to the toner powder 10 stuck to the surface 2*a* of the contact charging member 2 in the removing direction of the toner powder 10.

Figure 4:
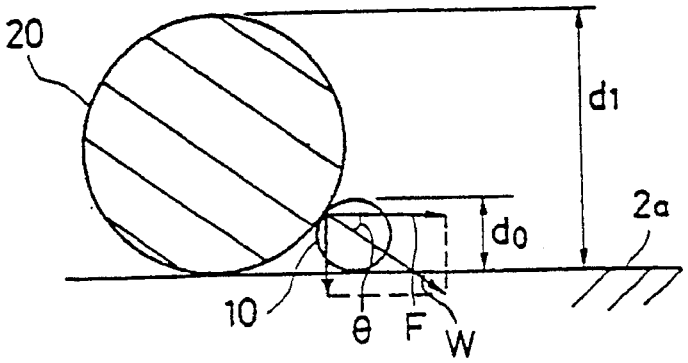
FIG. 4 is a front view, partly in section, for explaining a force of fibers (thick fibers) of a cleaning member acting on toner powder.
Figure 5:
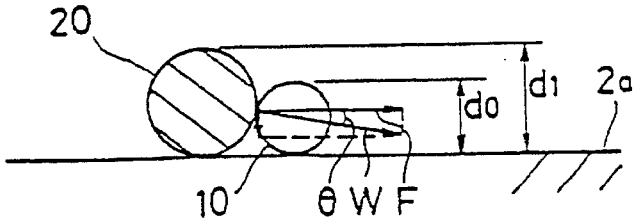
FIG. 5 is a front view, partly in section, for explaining a force of fibers (thin fibers) of a cleaning member acting on toner powder.

Operation will now be describe with reference to FIGS. 4 and 5. As shown in FIG. 4, in case the fibers 20 of the cleaning member 8 have too large diameter d1 compared with the average particle diameter d0 of the toner powder 10, an angle θ becomes large which is formed between the acting force W exhibited when the fibers 20 contact the toner powder 10 and the toner powder removing direction which is the tangential direction of the contact charging member 2 at the adhering portion of the toner powder 10. As a consequence, the component force F (=cos θ) in the toner powder removing direction of the acting force W is decreased.

In contrast, as shown in FIG. 5, in case the fibers 20 of the cleaning member 8 have the diameter d1 not too large compared with the average particle diameter d0 of the toner powder 10, the angle θ becomes small which is formed between the acting force W exhibited when the fibers 20 contact the toner powder 10 and the removing direction. As a consequence, the component force F (=cos θ) in the toner powder removing direction of the acting force W is increased.

From the foregoing, by forming the fibers 2 constituting the group of fibers arranged at the slide-contact portion of the cleaning member 8 not to be too thick compared with the average particle diameter d0 of the toner powder supplied from the developing unit 4 and preferably to be a thickness d1 less than twice the average particle diameter d0 of the toner powder 10, the force W to be act on the toner powder 10 in the removing direction of the toner powder 10 can be increased and the cleaning effect is enhanced.

Figure 6:
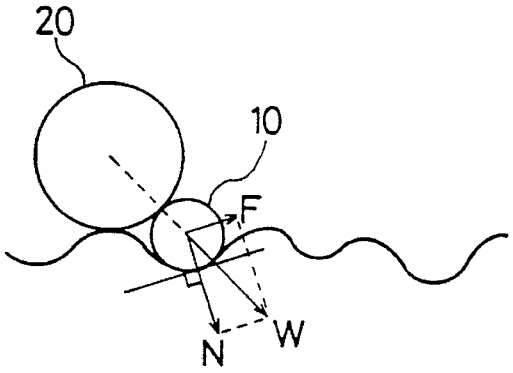
FIG. 6 is another explanatory view for explaining a force of fibers (thick fibers) of a cleaning member acting on toner powder.

FIG. 6 is an explanatory view showing concavities and convexities having a height less than but proximate to the average particle diameter of the toner powder in the removing direction (tangential direction) of the contact charging member 2. IN this case, the acting force W of the fibers 20 is decomposed into a pressing force N perpendicular to the tangential line passing through the contact point between the toner powder 10 and the surface and into a component force F. Since this component force F is smaller than the component force F shown in FIG. 5 but larger than a frictional resistance force N μ which is expressed by a product of the pressing force N and the friction coefficient μ of the contact charging member 2, the toner powder 10 can be removed by this component force F. Since the surface layer is constituted of a low friction material, the toner powder 10 can efficiently be removed.

EMBODIMENT 1

An image forming apparatus schematically shown in FIG. 7 was used. Toner powder 10 having an average particle diameter of 9 μm was supplied from the developing unit 4, and effects of cleaning on the contact charging member 2 made by the cleaning member 8 were measured, while varying the roughness of the surface of the contact charging member 2 in many ways. The cleaning member 8 used here had a nonwoven fabric made of polyester, pasted up on its slide-contact portion with respect to the contact charging member 2. The thickness of the nonwoven fabric was 27 μm.

Results of the measurements are shown in Table 1.

TABLE 1

| Fiber thickness | Particle diameter of toner | Surface roughness of contact charging member (Rmax) | Soil of contact charging member (after supply of 5000 sheets of paper |
|---|---|---|---|
| 27 μm | 9 μm | 4 to 9 μm | slight soil was generated over entirety |
| 27 μm | 9 μm | 5 to 12 μm | large soil was partly generated |
| 27 μm | 9 μm | 10 to 20 μm | large soil was generated on several spots |

From the above results, in case the maximum height (surface roughness) of the concavities and convexities existing on the surface of the contact charging member 2 was equal to or less than the average particle diameter (8 μm) of the toner powder 10, there was no multilevel or dense adhesion of the toner powder 10 and an image failure, such as white stripes, was effectively prevented.

That is, there is no practical inconvenience even if a slight soil is generated over the entirety of the contact charging member 2 after the completion of supply of 5000 sheets of paper.

EMBODIMENT 2

An image forming apparatus schematically shown in FIG. 7 was used. Toner powder 10 having an average particle diameter of 12 μm was supplied from the developing unit 4, and effects of cleaning on the contact charging member 2 made by the cleaning member 8 were measured, while varying the roughness of the surface of the contact charging member 2 in many ways. The cleaning member 8 used here had a nonwoven fabric made of polyester, pasted up on its slide-contact portion with respect to the contact charging member 2. The maximum height (surface roughness) of the concavities and convexities existing on the surface of the contact charging member 2 was 6 to 12 μm.

Results of the measurement are shown in Table 2.

TABLE 2

| Fiber thickness | Particle diameter of toner | Surface roughness of contact charging member (Rmax) | Soil of contact charging member (after supply of 5000 sheets of paper |
|---|---|---|---|
| 10 μm | 12 μm | 5 to 12 μm | almost no soil was generated |
| 20 μm | 12 μm | 5 to 12 μm | slight soil was partly generated |
| 27 μm | 12 μm | 5 to 12 μm | slight soil was generated over entirety |

From the above results, when the thickness of fibers of the cleaning member 8 was less than about twice the average particle diameter (12 μm) of the toner powder 10, these was no multilevel or dense adhesion of the toner powder 10 and an image failure, such as white stripes, was effectively prevented.

What is claimed is:

1. An image forming apparatus comprising a contact charging member which contacts a surface of an image carrier member in order to charge the surface of said image carrier member, and a cleaning member which contacts and slides on a surface of said contact charging member in order to clean the surface of said contact charging member, said image forming apparatus performing a function in such a way that after an electrostatic latent image is produced on said image carrier member which is in a charge state, toner powder is supplied to said image carrier member by developing means in order to visualize the electrostatic latent image and then a visualized image is transferred to a transfer member, wherein a maximum height of concavities and convexities formed on the surface of said contact charging member is equal to or less than an average particle diameter of the toner powder supplied by said developing means.

2. An image forming apparatus according to claim 1, wherein said maximum height of concavities and convexities is equal to or more than 2 μm.

3. An image forming apparatus according to claim 1, wherein a slide contact portion of said cleaning member with respect to said contact charging member is constituted of a group of fibers, and a thickness of each fiber constituting said group of fibers is equal to or less than twice the average particle diameter of the toner powder.

4. An image forming apparatus according to claim 2, wherein a slide contact portion of said cleaning member with respect to said contact charging member is constituted of a group of fibers, and a thickness of each fiber constituting said group of fibers is equal to or less than twice the average particle diameter of the toner powder.

5. An image forming apparatus according to claim 1, wherein said contact charging member is constituted of a roller, said roller having a rubber elastic layer on an upper layer of a conductive core, said rubber elastic layer having a surface layer formed on a surface thereof.

6. An image forming apparatus according to claim 3, wherein the average particle diameter of said toner powder is equal to or less than 12 μm.

7. An image forming apparatus according to claim 1, wherein the average particle diameter of said toner powder is equal to or less than 8 μm.

* * * * *

UNITED STATES PATENT AND TRADEMARK OFFICE

CERTIFICATE OF CORRECTION

PATENT NO. : 5,610,691

DATED : March 11, 1997

INVENTOR(S) : Sadao TAKAHASHI et al.

It is certified that error appears in the above-indentified patent and that said Letters Patent is hereby corrected as shown below:

In column 6, line 50, change "fibers 2" to --fibers 20--.

Signed and Sealed this

Twentieth Day of May, 1997

*Attest:*

Bruce Lehman

BRUCE LEHMAN

*Attesting Officer*

*Commissioner of Patents and Trademarks*